US007665170B2

(12) United States Patent
Stapel

(10) Patent No.: US 7,665,170 B2
(45) Date of Patent: Feb. 23, 2010

(54) DEVICE AND METHOD FOR COUPLING A VESSEL TO A STATIONARY OBJECT

(75) Inventor: Hendrik Pieter Stapel, Spaarndam West (NL)

(73) Assignee: Fabricom Oil & Gas BV (NL)

( * ) Notice: Subject to any disclaimer, the term of this patent is extended or adjusted under 35 U.S.C. 154(b) by 545 days.

(21) Appl. No.: 11/578,017

(22) PCT Filed: Apr. 5, 2005

(86) PCT No.: PCT/NL2005/000255

§ 371 (c)(1),
(2), (4) Date: Oct. 10, 2006

(87) PCT Pub. No.: WO2005/097591

PCT Pub. Date: Oct. 20, 2005

(65) Prior Publication Data

US 2008/0289126 A1 Nov. 27, 2008

(30) Foreign Application Priority Data

Apr. 9, 2004 (NL) ..... 1025923

(51) Int. Cl.
*E01D 15/00* (2006.01)

(52) U.S. Cl. ..... 14/71.3; 14/71.5; 114/230.17

(58) Field of Classification Search ..... 14/71.1, 14/71.3; 114/230.17
See application file for complete search history.

(56) References Cited

U.S. PATENT DOCUMENTS

| | | | | |
|---|---|---|---|---|
| 4,003,473 | A * | 1/1977 | Ryan | 14/71.7 |
| 4,043,288 | A * | 8/1977 | Vulovic | 114/382 |
| 4,083,072 | A * | 4/1978 | Ryan | 14/69.5 |
| 4,133,283 | A * | 1/1979 | Ryan | 114/230.18 |
| 4,157,742 | A * | 6/1979 | Aanensen | 182/97 |
| 4,169,296 | A * | 10/1979 | Wipkink et al. | 14/71.1 |
| 4,333,196 | A * | 6/1982 | Bougaran | 14/71.7 |
| 4,366,591 | A | 1/1983 | Zimmerman | |
| 4,473,916 | A * | 10/1984 | Connold | 14/42 |
| 4,590,634 | A | 5/1986 | Williams | |
| 6,131,224 | A | 10/2000 | Bernal | |
| 6,923,140 | B1 * | 8/2005 | Cook | 114/362 |
| 6,955,134 | B2 * | 10/2005 | Prins | 114/230.17 |

FOREIGN PATENT DOCUMENTS

| | | |
|---|---|---|
| GB | 2246992 A | 2/1992 |
| WO | WO 87/02723 | 5/1987 |
| WO | WO 00/15489 | 3/2000 |
| WO | WO02/20343 A1 | 3/2002 |

* cited by examiner

*Primary Examiner*—Gary S Hartmann
(74) *Attorney, Agent, or Firm*—Hoffmann & Baron, LLP

(57) ABSTRACT

The invention relates to a device for making a walkway from a vessel to an object which is more or less stationary relative to the vessel and has a gangplank attached to the vessel. The gangplank has a top surface and near the end of the gangplank a coupling element for enclosing a horizontal pipe attached to the stationary object. According to the invention, the coupling element is fitted below the top surface, and near the coupling element on the underside in the longitudinal direction of the gangplank the gangplank has a narrow supporting edge for supporting the gangplank on the pipe. The invention also comprises a method for the use of the device.

14 Claims, 3 Drawing Sheets

DEVICE AND METHOD FOR COUPLING A VESSEL TO A STATIONARY OBJECT

CROSS-REFERENCE TO RELATED APPLICATIONS

This application is the National Stage of International Application No. PCT/NL2005/000255, filed Apr. 5, 2005, which claims the benefit of Netherlands Application No. 1025923, filed Apr. 9, 2004, the contents of which are incorporated by reference herein.

FIELD OF THE INVENTION

The invention relates to a device for coupling a vessel to a stationary object.

BACKGROUND OF THE INVENTION

Such a device is known from WO 0220343. The disadvantage of the known device is that placing the coupling element around the pipe is difficult because the coupling element keeps constantly moving under the influence of waves and it is difficult for the drive means to compensate for this movement.

SUMMARY OF THE INVENTION

In order to avoid this disadvantage, the present invention provides a device for making a walkway from a vessel to an object which is more or less stationary relative to said vessel, comprising a telescopingly extendable gangplank attached to said vessel and having a top surface, and in which near the end of said gangplank a coupling element is provided which is adapted for enclosing a pipe that is attached to the stationary object, said gangplank being provided with first drive means for rotating said gangplank relative to said vessel about a first pin and a second pin situated more or less perpendicular to said first pin, and being provided with second drive means for extending said gangplank in length, and with control means for controlling said device during coupling of said coupling element with the pipe, wherein said coupling element is arranged to enclose a more or less horizontal pipe, said coupling element is fitted below said top surface, and near said coupling element on the underside in the longitudinal direction of said gangplank said gangplank has a narrow supporting edge for supporting said gangplank on the pipe.

This ensures that the gangplank can first be placed on the horizontal pipe, so that the coupling element is subsequently easy to place around the horizontal pipe.

According to an improvement, the device is designed such that on either side of said supporting edge said underside of the gangplank lies above a V-shaped section. This means that the gangplank can lie obliquely on the pipe before the coupling element falls around the pipe.

According to a further improvement, the device is designed such that said coupling element is rotatable about a third pin which is in a position more or less perpendicular to said top surface. This means that in the coupled state the gangplank can form an angle with the pipe.

According to a further improvement, the device is designed such that said coupling element has a supporting surface extending from said supporting edge to said top surface and lying between said third pin and said supporting edge. This means that during the coupling the coupling element aligns itself according to the direction of the pipe.

According to a further improvement, the device is designed such that said coupling element is provided with elastic means for taking said coupling element into a central position. This means that prior to the coupling the coupling element is in the position suitable for coupling.

According to a further improvement, the device is designed such that said coupling element has a clamp for enclosing the pipe in a coupled state. This means that a reliable coupling is obtained between the vessel and the object.

According to a further improvement, the device is designed such that said control means comprise a first sensor for detecting a presence of the pipe in said coupling element. This means that after the coupling the drive means of the gangplank can be switched off.

According to a further improvement, the device is designed such that said control means comprise a second sensor for detecting a loading and/or overloading of said clamp. This means that the loading and/or overloading of the construction is known in the control system and that measures can be taken if necessary. The result is that damage to the device can be prevented or limited.

According to a further improvement, the device is designed such that said control means are designed for opening said clamp and/or switching on said first drive means after a detection of overloading of said clamp. This means that in the event of overloading damage is prevented, and also that on uncoupling of the gangplank from the pipe the gangplank drops down.

According to a further improvement, the device is designed such that said coupling element and said gangplank are designed in such a way that a coupled pipe, measured parallel to said top surface, can form an angle of at least thirty to forty-five degrees with a line perpendicular to said longitudinal direction of said gangplank. This means that it is not necessary for the vessel to lie precisely straight in front of the pipe in order to connect the gangplank to the object.

According to a further improvement, the device is designed such that said coupling element is designed in such a way that a coupled pipe can form an angle of at least ten to twenty degrees with said top surface. This means that it is not necessary for the pipe to be at a constant height relative to the water surface in order to couple the gangplank to the object.

According to an improvement, the device is designed such that a support is provided above the pipe in order to limit the movements of said gangplank in the horizontal direction. This means that during the coupling to the object the gangplank is easy to position above the horizontal pipe.

The present invention also comprises a method for coupling a vessel to a stationary object. Such a method is known from WO 0220343. The disadvantage of the known method is that the coupling of the gangplank to the object makes accurate control necessary.

In order to avoid this disadvantage, the present invention provides a method for making a walkway from a vessel to an object which is more or less stationary relative to said vessel by providing a telescopingly extendable gangplank between said vessel and said object, said gangplank being attached to said vessel and, inter alia, being provided with first drive means for lifting and swivelling said gangplank, and with second drive means for changing the length of said gangplank, and on the underside being provided with a coupling element which is adapted for coupling said gangplank to a pipe that is attached to said object, wherein during coupling said gangplank is laid on said horizontal pipe, after which the length of said gangplank is adjusted by said second drive means until said coupling element falls around said pipe. This means that the gangplank is coupled in a simple manner to the object, so that difficult positioning actions are avoided.

According to an improvement, the method is carried out such that a support is provided above said horizontal pipe and said gangplank is pressed against said support before said gangplank is laid on said pipe. This means that the coupling is simplified further.

BRIEF DESCRIPTION OF THE DRAWINGS

The invention is explained below on the basis of an exemplary embodiment with reference to a drawing, in which.

DETAILED DESCRIPTION OF THE PREFERRED EMBODIMENTS

Figure 1:
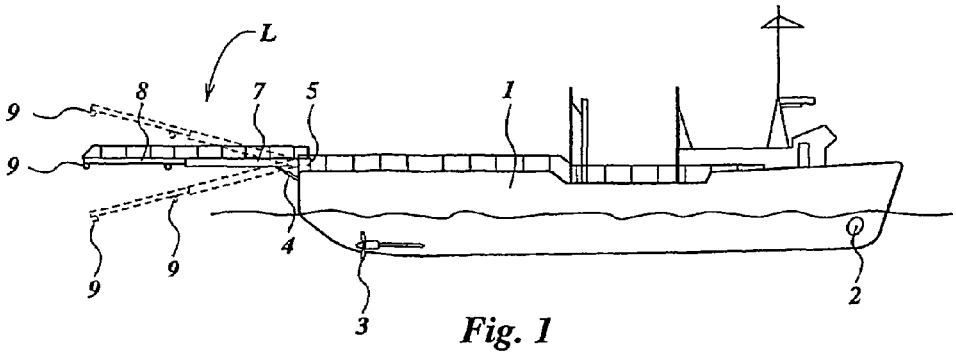
FIG. 1 shows a side view of a vessel with a gangplank.
Figure 2:
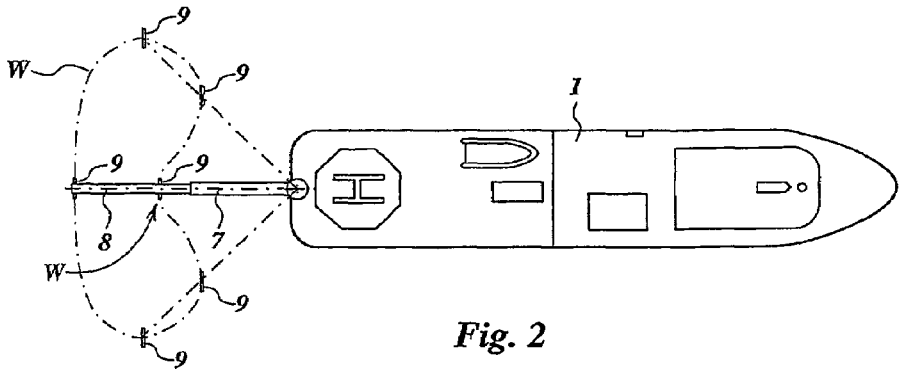
FIG. 2 shows a top view of the vessel of FIG. 1.

FIGS. 1 and 2 show a vessel 1 with a propulsion system consisting of, inter alia, propellers 3 and a bow thruster 2. A pivot point 5, to which a gangplank L is attached, is provided on the stern of the vessel 1, which gangplank has a first gangplank part 7 and a second gangplank part 8 which telescopes into said first gangplank part. The first gangplank part 7 is attached to the pivot point 5 by means of a pivot pin 6 and can be moved in the vertical plane by a lifting cylinder 4. By means of a drive (not shown) the gangplank L can rotate about a vertical axis of the pivot point 5, with the result that the gangplank L can be laid on the afterdeck of the vessel 1 during transport. During use the gangplank L is moved to a position behind the vessel 1.

The end of the second gangplank part 8 is provided, in a manner to be indicated below, with coupling means K, by means of which the gangplank L can be coupled to a coupling pipe 9, which forms part of a stationary object 14 placed in the sea, such as a drilling platform (see FIG. 3). Owing to the fact that the gangplank L can rotate about the vertical axis of the pivot point 5, the second gangplank part 8 telescopes into the first gangplank part 7 and the gangplank L can be swung upwards about the pivot pin 6, the coupling means K can cover a working range W which lies beside or preferably behind the vessel 1, so that the coupling means K can acquire an adjustable height above the water surface. This means that the coupling pipe 9 can have a varying height above the water surface, with the result that use is independent of the water level.

Figure 3:
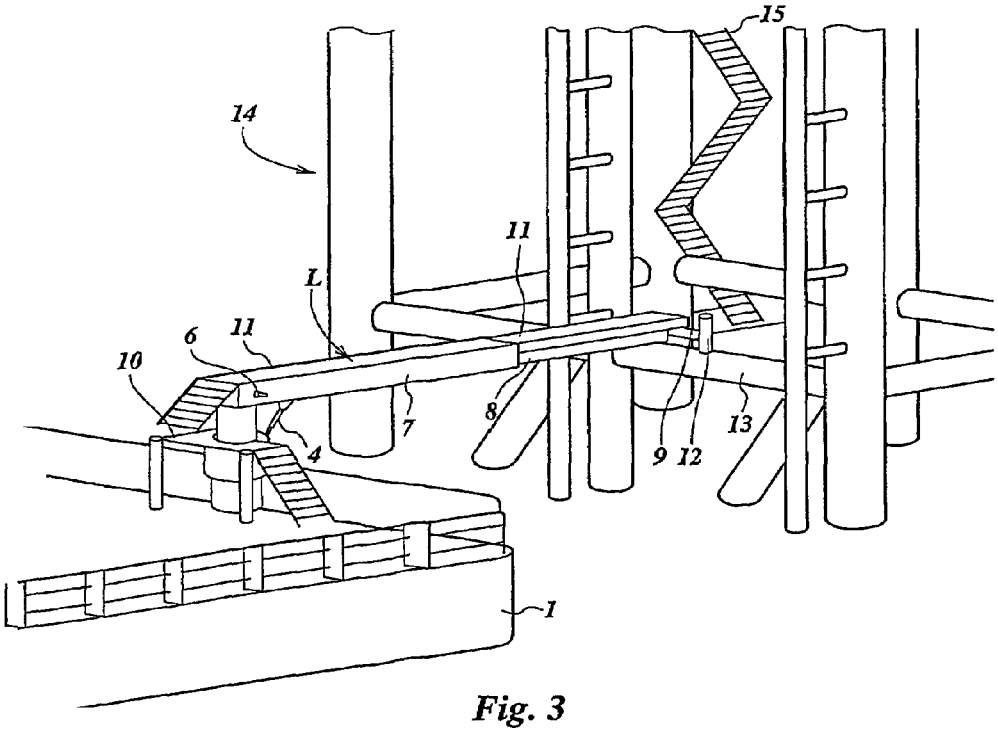
FIG. 3 shows a perspective view of the vessel of FIG. 1 coupled at a platform.
Figure 4:
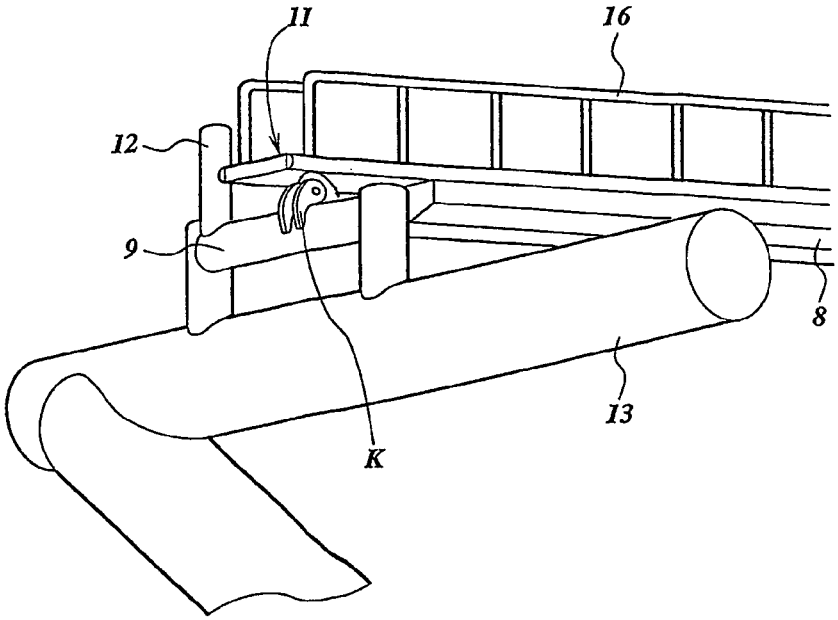
FIG. 4 shows a perspective bottom view of the coupling of the vessel of FIG. 1 to the platform.
Figure 5:
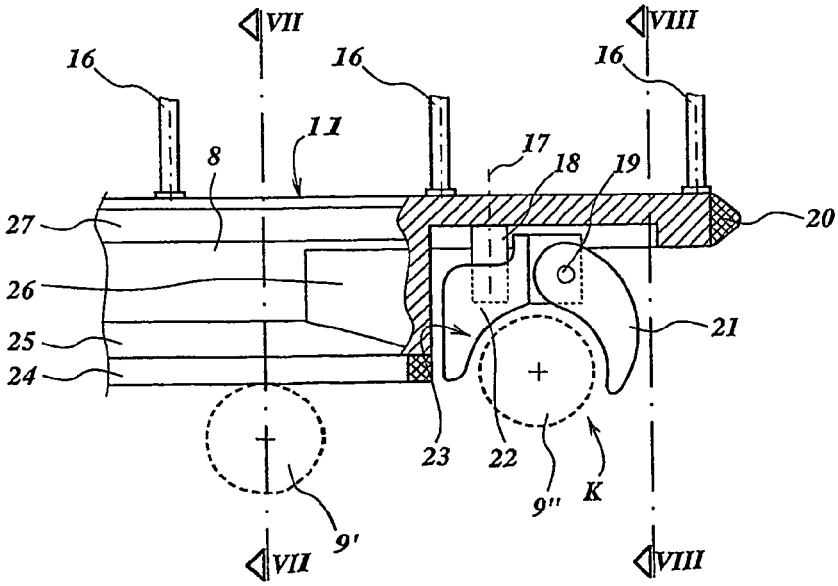
FIG. 5 shows a side view with partial cross section of the gangplank at the position of the coupling to the platform.
Figure 6:
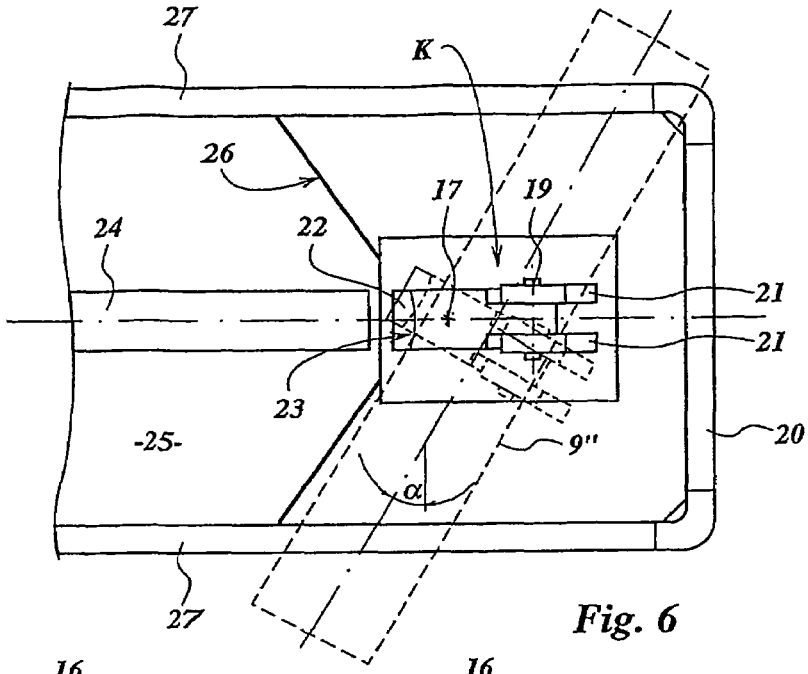
FIG. 6 shows a bottom view of the gangplank at the position of the coupling to the platform.
Figure 7:
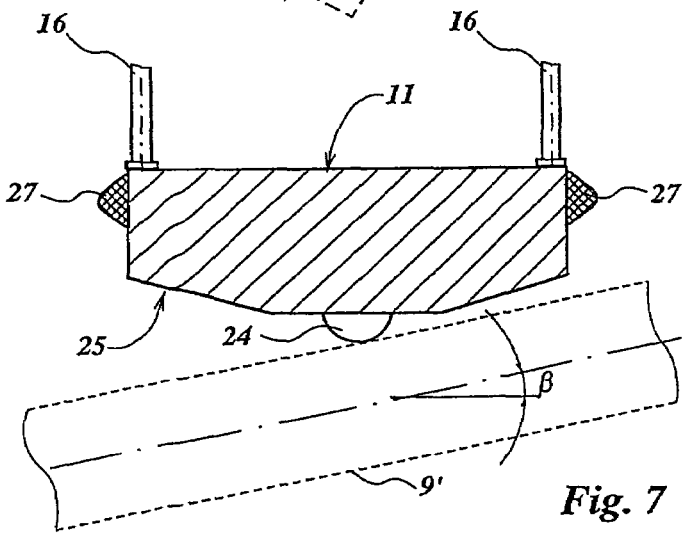
FIG. 7 shows a cross section VII-VII of the gangplank at the position of the coupling to the platform.
Figure 8:
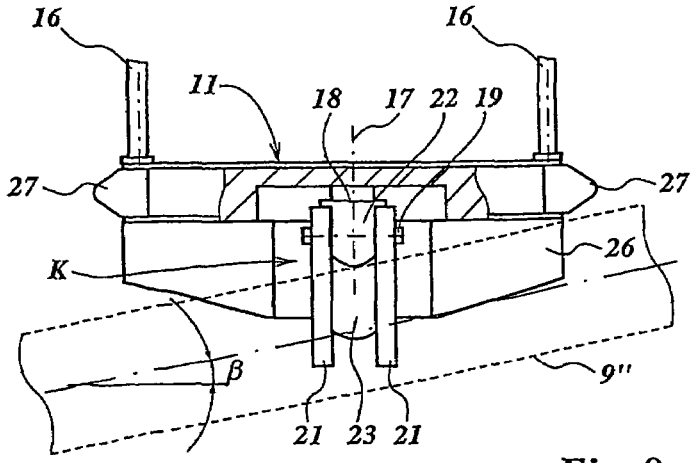
FIG. 8 shows a side view and cross section VIII-VIII of the gangplank at the position of the coupling to the platform.

FIGS. 3 and 4 show how the vessel 1 is coupled to a platform 14 such as a drilling platform. A coupling pipe 9 is attached to a coupling pipe 13 of the platform 14. A support 12, in the form of a vertical pipe here, is placed on one of the ends of the coupling pipe 9. The end of the second gangplank part 8 rests with the coupling means K around the coupling pipe 9. The first gangplank part 7 and the second gangplank part 8 are provided on the top side with a walkway 11 having on either side a railing 16 (which for the sake of clarity is not shown in FIG. 3).

On the vessel 1 the walkway 11 is connected by means of one or more steps and a stationary landing 10 to the afterdeck of the vessel 1. On the platform 14 there are also facilities such as landings for connecting the walkway 11 to a ladder 15. The second gangplank part 8 may, if required, be provided on the end with a fold-down part (not shown) which connects to steps leading to the ladder 15.

Coupling the vessel 1 to the platform 14 by means of the gangplank L enables visitors to go onto the platform 14 from the vessel 1 and back.

In order to take visitors to the platform 14, the vessel 1 sails to the platform 14. By means of the propulsion system, and possibly using a dynamic positioning system, or by means of hawsers attached to anchors or to the platform 14, the vessel 1 positions itself beside the platform 14 in such a way that the coupling pipe 9 is lying within the range of the coupling means K on the end of the second gangplank part 8. During the coupling of the vessel 1, the vessel 1 moves relative to the platform 14, inter alia as a result of swell, current and the like. By means of the propulsion system, the vessel 1 is sailed to the platform 14 until the coupling pipe 9 comes within the working range W, and by adjustment of the direction, slope and length of the gangplank L the coupling means K on the end of the gangplank L are taken above the coupling pipe 9, and the coupling to the platform 14 is achieved. If required, the vessel is positioned beside the platform 14 by means of hawsers attached to anchors or to the platform 14.

FIGS. 5-8 show the end of the gangplank L with the coupling means K. On the side edges of the walkway 11 a bumper strip 27 is provided along the side edges of the end of the second gangplank part 8, and a bumper strip 20 is provided on the end of the second gangplank part 8. The coupling means K are provided on the underside in a recess on the end of the second gangplank part 8. A pin 18 with an axis 17 extending perpendicularly to the walkway 11 is fixed on the second gangplank part 8. A coupling piece 22 can rotate about the pin 18, starting from a central position and rotating towards each side about the axis 17 through a first angle $\alpha$, with the result that the direction of the coupling piece 22 can adapt to the direction in which the coupling pipe 9" to be gripped is situated relative to the gangplank L. To this end, the second gangplank part 8 is also made of a thinner design locally and has a recess with slanting faces 26, in such a way that on rotation of the coupling piece 22 through a first angle $\alpha$ a clamped coupling pipe 9" does not come into contact with the gangplank L. If required, blocking means which limit maximum values of the first angle $\alpha$ may be provided. In a preferred embodiment there are means (not shown) which hold the coupling piece 22 directed elastically in the centre of the second gangplank part 8, in which case the first angle $\alpha$ is equal to zero. The maximum value of the first angle $\alpha$ is approximately thirty to forty-five degrees.

Two clamps 21 are fixed on the coupling piece 22, which clamps are movable about a pin 19 by means of a clamp drive (not shown) and can enclose and firmly clamp the coupling pipe 9". The clamp drive is designed in such a way that if the load is too great, the clamps 21 open and the coupling pipe 9 can come away from the clamping means K. To this end, the coupling piece 22 and/or the drive of the clamps 21 is/are provided with sensors which can measure the forces exerted by the coupling pipe 9" on the coupling piece. There are also sensors which detect the presence of coupling pipe 9" in clamping means K. Said sensors are connected to a control system of the device.

Near the coupling means K, the underside of the second gangplank part 8 is provided in the centre of the end with a supporting edge 24. The underside of the second gangplank part 8 is provided on either side of the supporting edge 24 with bevelled areas 25, with the result that the plane of the walkway 11 of the second gangplank part 8 can form a second angle β with the direction of the coupling pipe 9'. In practice, the maximum value of the second angle β in a plane perpendicular to the gangplank L is fifteen to twenty degrees, said angle being dependent, inter alia, on the angle between the gangplank L and the coupling pipe 9 and the height of the horizontal pipe 9 relative to the pivot pin 6 of the gangplank L. The coupling piece 22 and the clamps 21 are shaped in such a way that the coupling pipe 9" also in the coupled position can form a second angle β with the plane of the walkway 11.

During coupling of the gangplank L to the platform 14 the vessel 1 is taken into a more or less stationary position near the platform 14. The end of the gangplank L is then taken above the coupling pipe 9, and the bumper strip 27 on the side edge of the gangplank L is taken against the support 12 and pressed against it there with a pressure force. Subsequently or immediately, depending on the circumstances, the operator lowers the gangplank L until the latter is lying with the supporting edge 24 on the coupling pipe 9, and the lifting cylinder 4 is relieved so that the gangplank L remains with the supporting edge 24 resting by its own weight on the coupling pipe 9, in which case the side edge is pressed against the support 12. The second gangplank part 8 is then retracted into the first gangplank part 7, so that the supporting edge 24 slides over the coupling pipe 9.

When the coupling pipe 9 is on the end of the supporting edge 24 the end of the gangplank L moves downwards, so that the coupling piece 22 encloses the coupling pipe 9. In the course of this process the coupling piece 22 rotates about the axis 17 through the fact that the coupling pipe 9 slides along a supporting surface 23 of the coupling piece 22 lying between the supporting edge 24 and the axis 16 to its lowest point and reaches the position shown by dashed lines in FIG. 6. The presence of the coupling pipe 9" is detected by the sensor and passed on to the control means. The clamps 21 are then activated so that the coupling pipe 9" is clamped and the power is removed from the drives for lifting, rotation and sliding out of the gangplank L. As a result, the vessel 1 can move slightly relative to the platform 14, and the vessel 1 can follow the slighter movements of swell and current without great forces being exerted upon the construction. The propulsion system and/or the anchoring of the vessel 1 ensure that great movements do not occur. If as a result of fault or too strong wind, swell or current, excessive movements do still occur, the sensor detects the magnitude of the forces in the coupling means. If necessary, the propulsion system and/or positioning of the vessel 1 is/are adjusted. If the measured forces become too great, the clamp 21 opens and under the influence of the control system the drives of the gangplank L are switched on again and the gangplank L is put back on the vessel 1.

It will be clear to the person skilled in the art that, apart from the embodiment described above, many alternative embodiments are possible for the device. For example, it is possible to provide the coupling means at some distance from the end of the second gangplank part 8, instead of on the end of said gangplank part. During coupling of the gangplank L the length is not shortened, but extended in that case. Embodiments in the case of which the coupling piece 22 does not have clamps 21, but in the case of which the coupling piece firmly encloses the coupling pipe 9 purely through its shape, are also possible.

What is claimed is:

1. Device for making a walkway from a vessel to an object which is relatively stationary to said vessel, comprising a telescopingly extendable gangplank attached to said vessel and having a top surface and an underside, and in which near the end of said gangplank a coupling element is provided which is adapted for enclosing a pipe that is attached to the stationary object, said gangplank being provided with first drive means for rotating said gangplank relative to said vessel about a first pin and a second pin situated substantially perpendicular to said first pin, and being provided with second drive means for extending said gangplank in length, and with control means for controlling said device during coupling of said coupling element with the pipe, wherein said coupling element is arranged to enclose a substantially horizontal pipe, said coupling element is fitted below said top surface, and near said coupling element on the underside in the longitudinal direction of said gangplank said gangplank has a narrow supporting edge for supporting said gangplank on the pipe.

2. Device according to claim 1, in which on either side of said supporting edge said underside of the gangplank lies above a V-shaped section.

3. Device according to claim 1, in which said coupling element is rotatable about a third pin which is in a position substantially perpendicular to said top surface.

4. Device according to claim 3, in which said coupling element has a supporting surface extending from said supporting edge to said top surface and lying between said third pin and said supporting edge.

5. Device according to claim 3, in which said coupling element is provided with elastic means for taking said coupling element into a central position.

6. Device according to claim 1, in which said coupling element has a clamp for enclosing the pipe in a coupled state.

7. Device according to claim 1, in which said control means comprise a first sensor for detecting a presence of the pipe in said coupling element.

8. Device according to claim 6, in which said control means comprise a second sensor for detecting a loading and/or overloading of said clamp.

9. Device according to claim 8, in which said control means are capable of opening said clamp and/or switching on said first drive means after a detection of overloading of said clamp.

10. Device according to claim 1, in which said coupling element and said gangplank are designed in such a way that a coupled pipe, measured parallel to said top surface, can form a maximum angle of thirty to forty-five degrees with a line perpendicular to said longitudinal direction of said gangplank.

11. Device according to claim 1, in which said coupling element is designed in such a way that a coupled pipe can form a maximum angle of ten to twenty degrees with said top surface.

12. Device according to claim 1, in which a support is provided above the pipe to limit movements of said gangplank in the horizontal direction.

13. Method for making a walkway from a vessel to an object which is relatively stationary to said vessel by providing a telescopingly extendable gangplank between said vessel and said object, said gangplank being attached to said vessel and being provided with first drive means for lifting and swiveling said gangplank, and with second drive means for changing the length of said gangplank, and an underside of said gangplank being provided with a coupling element which is adapted for coupling said gangplank to a pipe that is attached to said object, wherein, during the step of coupling, said gangplank is laid on a horizontal pipe that is attached to the stationary object, after which a step of adjusting the length of said gangplank is performed by said second drive means until said coupling element falls around said pipe.

14. Method according to claim 13, in which a support is provided above said horizontal pipe and a step of pressing said gangplank against said support is performed before a step of laying said gangplank on said pipe is performed.

* * * * *